US009796554B2

(12) United States Patent
Cedeno et al.

(10) Patent No.: US 9,796,554 B2
(45) Date of Patent: Oct. 24, 2017

(54) MEDIA ACCUMULATOR-EJECTOR FOR USE WITH AN IMAGING DEVICE

(71) Applicant: LEXMARK INTERNATIONAL, INC., Lexington, KY (US)

(72) Inventors: Meneleo De Castro Cedeno, Iligan (PH); Aaron Jacob Boggs, Lexington, KY (US); Jose Jonna Tohay Chavez, Daanbantayan (PH); Jie Chen, Lexington, KY (US); Gerald Concejos Famador, Cebu (PH); Gregory Michael Hensley, Lexington, KY (US); Kim Mataciños Kekim, Lapulapu (PH); Donald Norman Spitz, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/427,327

(22) Filed: Feb. 8, 2017

(65) Prior Publication Data

US 2017/0158451 A1 Jun. 8, 2017

Related U.S. Application Data

(63) Continuation of application No. 14/960,630, filed on Dec. 7, 2015, now Pat. No. 9,639,048.

(51) Int. Cl.
*B65H 29/12* (2006.01)
*B65H 31/30* (2006.01)
(Continued)

(52) U.S. Cl.
CPC ..... *B65H 31/3027* (2013.01); *B65H 29/12* (2013.01); *B65H 29/125* (2013.01);
(Continued)

(58) Field of Classification Search
CPC .. G03G 15/6552; B65H 29/12; B65H 29/125; B65H 29/14; B65H 31/3027; B65H 2404/144; B65H 2404/1441
See application file for complete search history.

(56) References Cited

U.S. PATENT DOCUMENTS 7,520,505 B2 * 4/2009 Thomas ..... B65H 29/14 270/58.17
7,789,387 B2 * 9/2010 Trudeau ..... B65H 29/145 271/273
(Continued)

*Primary Examiner* — Jeremy R Severson
(74) *Attorney, Agent, or Firm* — John Victor Pezdek

(57) ABSTRACT

A media accumulator-ejector for use with an imaging apparatus. Rotatable upper and lower roll assemblies are located above and below a media accumulation zone comprised of an accumulation plate and positioned to receive media exiting an imaging device. The roll assemblies are moveable like jaws between an open position where media can accumulate on the accumulation plate without interference with the roll assemblies and a clamping position where the accumulated media is grasped by the upper and lower roll assemblies. The upper and lower roll assemblies are then rotated to eject the accumulated media from the accumulation plate. The upper and lower roll assemblies can also grasp and continuously eject individual sheets of media at a predetermined process speed.

13 Claims, 11 Drawing Sheets

(51) Int. Cl.

| | |
|---|---|
| ***G03G 15/00*** | (2006.01) |
| ***B65H 31/34*** | (2006.01) |
| ***B65H 29/14*** | (2006.01) |

(52) U.S. Cl.

CPC ..... *B65H 29/14* (2013.01); *B65H 29/145* (2013.01); *B65H 31/34* (2013.01); *G03G 15/6552* (2013.01); *B65H 2404/144* (2013.01); *B65H 2404/1441* (2013.01)

(56) References Cited

U.S. PATENT DOCUMENTS

| | | | | |
|---|---|---|---|---|
| 7,976,004 | B2 * | 7/2011 | Kimura | B65H 31/3027 270/58.08 |
| 9,639,048 | B1 * | 5/2017 | Cedeno | G03G 15/6552 |
| 2006/0202402 | A1 * | 9/2006 | Nagata | B42C 1/12 270/58.08 |
| 2007/0018385 | A1 * | 1/2007 | Park | B65H 5/062 271/272 |
| 2010/0150636 | A1 * | 6/2010 | Kubota | B42C 1/12 399/407 |

* cited by examiner

MEDIA ACCUMULATOR-EJECTOR FOR USE WITH AN IMAGING DEVICE

CROSS REFERENCES TO RELATED APPLICATIONS

The present application is related to U.S. patent application Ser. No. 14,960,630, entitled "A Media Accumulator-Ejector For Use With An Imaging Device," filed Dec. 7, 2015 and assigned to the assignee of the present application.

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Disclosure

The present disclosure relates generally to imaging devices and finishers, and more particularly to those having media accumulator-ejector.

Description of the Related Art

Stapler finishing devices have long been using a rubber finger, belt drive media accumulator-ejector devices. As shown in FIGS. 1 and 2, the prior art media accumulator-ejector 10 is typically made up of a frame 12 having mounted thereon two parallel, rotatable shafts 14, 16, positioned transverse to a media path P. Three belts 20, 21, 22 are mounted to the shafts 14, 16 and driven by a motor 30 via a gear train 32 and rotate parallel to media path P. Attached to the belts 20-22 are respective aligned, outwardly protruding rubber fingers 23-25, that extend out through slots provided in a media accumulation plate 40 that is formed as part of a cover 42. In operation, media is fed from an imaging device onto the accumulation plate 40 to form a media stack MS positioned downstream of the aligned fingers 23-25. When the media stack MS has been formed, the motor 30 is energized to rotate the belts 20-22 which move the fingers 23-25 into contact the trailing edge TE of the media stack MS and push the media stack along the accumulation plate 40. As the belts 20-22 continue to rotate, the media stack MS is ejected from the accumulation plate 40 to be received at a finisher 50 where a stapling may take place.

This prior art design does exhibit some drawbacks. There is a limited speed point in ejection of the media stack. This is due to the fact that rubber insert fingers 23-25 tend to bend or flex when driving a heavy or tall media stack MS from the accumulation plate 40. Failed to eject issues arise when one or more of the fingers 23-25 miss catching the trailing edge TE of the media stack MS or catch only a portion of the media stack MS which can occur when the media sheets are curling upward. Also, there is limited capability for single media sheet pass through feeding. The prior art design uses a media accumulation process for all media with all job types, for example, stapling, non-stapled, offset, non-offset, flushing/standard stacking, before media stack ejection will happen. This wastes time and reduces throughput speed performance. Lastly, there is a manufacturing and service challenge to properly time or align the fingers 23-25 during assembly or after belt replacement.

It would be advantageous to provide a media accumulator-ejector that overcomes the stated drawbacks. It would be further advantageous to have a media accumulator-ejector that can more reliably handle media that has curled. It would also be advantageous to have a media accumulator-ejector that does not interrupt continuous individual sheet media feeding.

SUMMARY

Disclosed is a media accumulator-ejector for use with an imaging apparatus. The media accumulator-ejector includes an upper roll and a lower roll mounted to a frame. The upper roll has a first shaft having a first and a second end and a first plurality of wheels spaced apart along the first shaft and a left and a right linkage having one end rotatably coupled to first and second ends of the first shaft, respectively, with the other end rotatably connected to the frame. The lower roll has a second shaft having a first and second end and a second plurality of wheels spaced apart on the second shaft and a left and a right V-linkage, each linkage being rotatably coupled to first and second ends, respectively, of the second shaft and to the frame. The upper and lower rolls extend transversely across the accumulation plate adjacent to the downstream end of the accumulation plate. When in a respective home position, the upper roll is positioned above an upper surface of the accumulation plate and the lower roll positioned below the accumulation plate. The accumulation plate is mounted on the frame and has an upstream end positioned adjacent a media output of an imaging device to receive media therefrom and the downstream end has a plurality of slots therethrough corresponding to the second plurality of wheels on the second shaft.

A drive mechanism includes a DC drive motor having an output shaft with an output gear, a first and a second pulley gear operatively coupled to the output gear, a first and a second pulley mounted on the first and the second shafts, a first and a second belt respectively operatively coupled to the first and the second pulleys and to the first and the second pulley gears. Rotation of the drive motor in a first direction ejects media from the accumulation plate. The DC drive motor may be a DC servo motor with an encoder for providing speed control of the DC drive motor or be a DC stepper motor.

A lift mechanism includes a lift shaft transversely extending across the accumulation plate and has a left and a right coupling gear mounted on a respective left and right end of the lift shaft and a left and a right camming wheel respectively positioned on the lift shaft adjacent to the left and the right coupling gears and between a lower and an upper arm of the left and the right V-linkages of the lower shaft. The lift mechanism further includes a left and a right sector gear operably coupled to the respective left and right coupling gears and to the left and right linkage arms of the upper roll. Rotation of the left and right sector gears rotates the left and the right linkage arms. A reversible lift stepper motor is provided and has an output shaft with an output gear that operably is coupled to one of the left and right coupling gears. Rotation of the lift motor in a first direction pivots the upper and the lower rolls apart and rotation in a second direction pivots the upper and the lower rolls toward each other.

A flag extends from one of the left and the right ends of the first shaft. A home position sensor is positioned on the frame adjacent to the flag. The home position sensor has an output signal having a first state with the flag being present thereat and the upper roll and lower rolls being at their respective home positions and a second state when the upper and lower rolls are rotated away from their home positions.

A controller is in operable communication with the lift motor, the drive motor and the home position sensor. The controller drives the lift motor to move the upper and lower rolls in a first direction until the home position sensor output signal is in the first state, and, when a media stack has accumulated on the accumulation plate, the controller drives the lift motor in the second direction to move the upper and lower rolls to engage the media stack and then drives the drive motor to rotate the upper and lower rolls to eject the media stack from the accumulation plate. When continuously feeding a plurality of individual media sheets from the accumulation plate, the controller drives the lift motor in the second direction to move the upper and the lower rolls to form a feed nip for engaging each individual media sheet. Then prior to the first media sheet of the plurality of individual media sheets arriving at the feed nip, drives the drive motor to rotate the upper and the lower rolls to a speed matching a speed of the first media sheet of the plurality of individual media sheets fed from the imaging device to for continuously ejecting the plurality of individual media sheets from the accumulation plate.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 2:
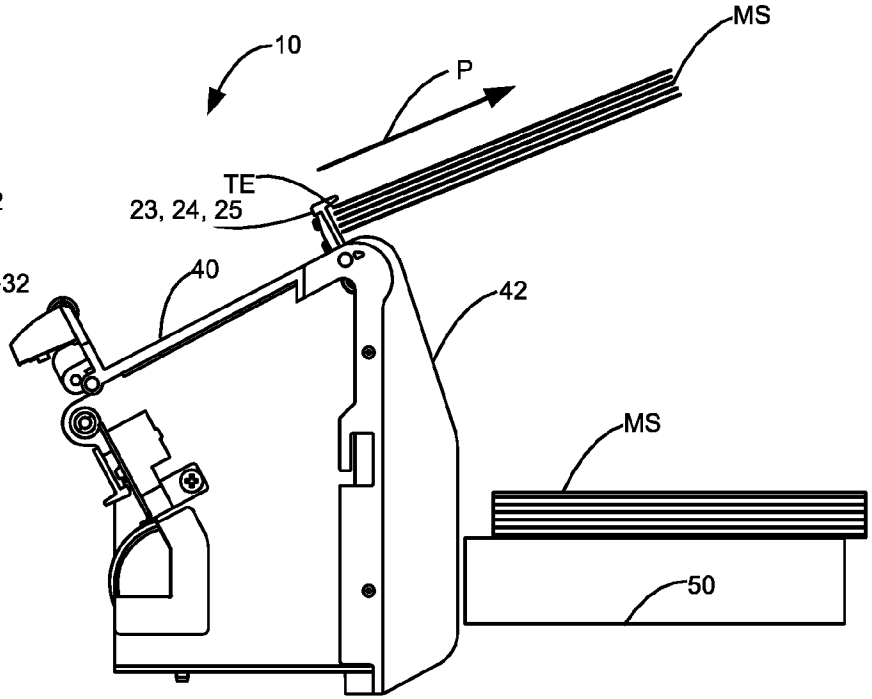
Figure 2 Prior Art
FIGS. 1 and 2 are illustrations of a prior art media accumulator-ejector.
Figure 1:
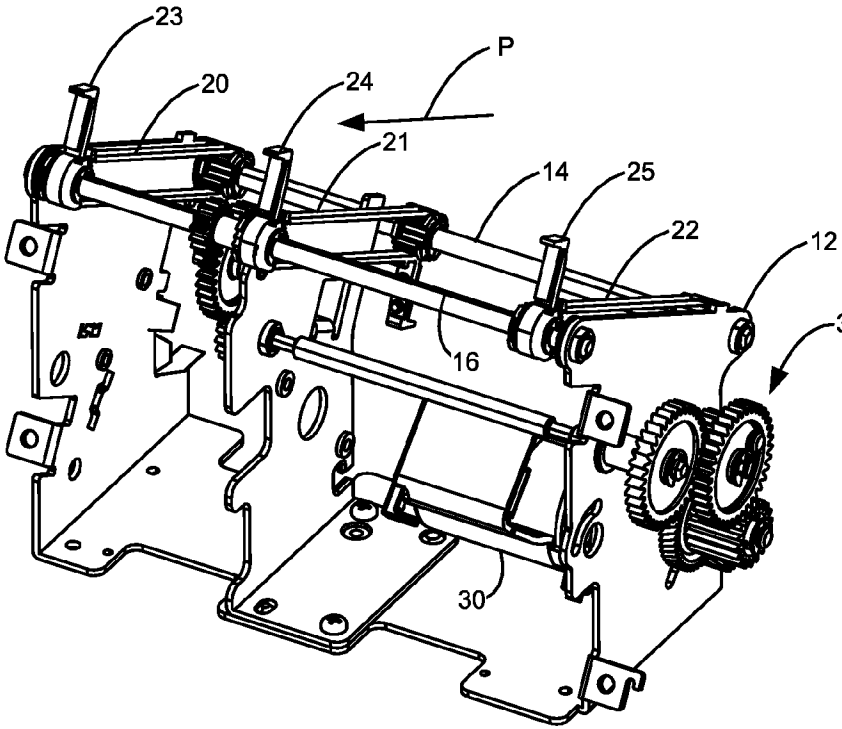
Figure 1 Prior Art

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open-ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items. Terms such as "about" and the like are used to describe various characteristics of an object, and such terms have their ordinary and customary meaning to persons of ordinary skill in the pertinent art.

Terms such as "about" and the like have a contextual meaning and are used to describe various characteristics of an object, and such terms have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

The term "image" as used herein encompasses any printed or electronic form of text, graphics, or a combination thereof. "Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging system. Further, relative positional terms may be used herein. For example, "superior" means that an element is above another element. Conversely "inferior" means that an element is below or beneath another element Media is conveyed using pairs of aligned rolls forming feed nips. The term "nip" is used in the conventional sense to refer to the opening formed between two rolls that are located at about the same point in the media path. The rolls forming the nip may be separated apart, be tangent to each other, or form an interference fit with one another. With these nip types, the axes of the rolls are parallel to one another and are typically, but do not have to be, transverse to the media path. For example, a deskewing nip may be at an acute angle with respect to the media feed path. The term "separated nip" refers to a nip formed between two rolls that are located at different points along the media path and have no common point of tangency with the media path. Again, the axes of rotation of the rolls having a separated nip are parallel but are offset from one another along the media path. Nip gap refers to the space between two rolls. Nip gaps may be positive, where there is an opening between the two rolls, zero, where the two rolls are tangentially touching, or negative, where there is an interference fit between the two rolls.

As used herein, the term "communication link" is used to generally refer to a structure that facilitates electronic communication among components. While several communication links are shown, it is understood that a single communication link may serve the same functions as the multiple communication links that are illustrated. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Devices interconnected by a communication link may use a standard communication protocol, such as for example, universal serial bus (USB), Ethernet or IEEE 802.xx, or other communication protocols. The terms "input" and "output" when applied to a sensor, circuit or other electronic device means an electrical signal that is produced by or is acted upon by such sensor, circuit or electronic device. Such electrical signals may be analog or digital signals.

Figure 3:
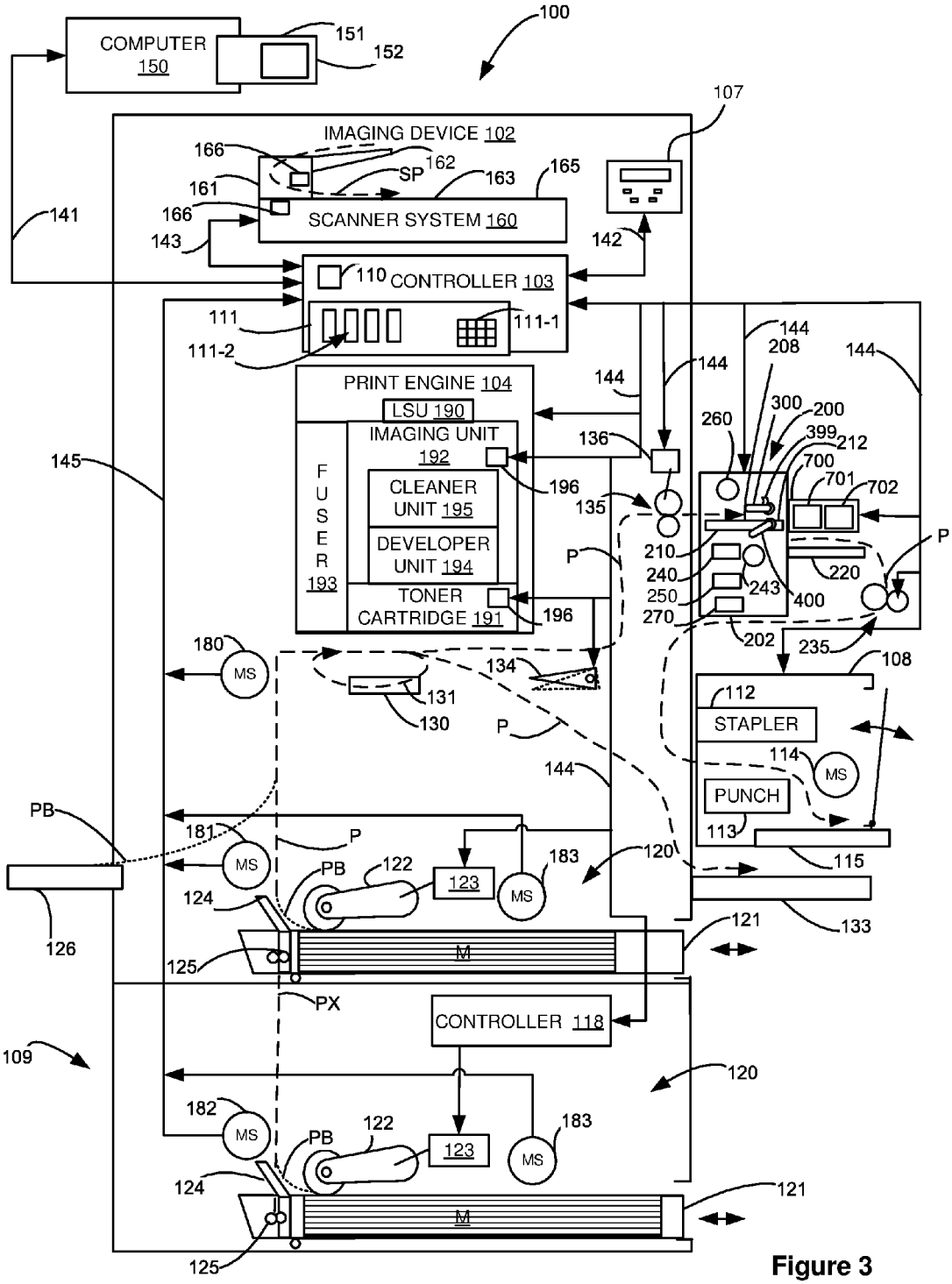
FIG. 3 is a schematic illustration of an imaging device and finisher with a media accumulator-ejector of the present disclosure.

Referring now to the drawings and particularly to FIG. 3, there is shown a diagrammatic depiction of an example imaging system 100. As shown, imaging system 100 may include an imaging device 102, and an optional computer 150 attached to the imaging device 102. Imaging system 100 may be, for example, a customer imaging system, or alternatively, a development tool used in imaging apparatus design. Imaging device 102 is shown as a multifunction machine that includes a controller 103, a print engine 104, a scanner system 160, a user interface 107, a finisher 108, an option assembly 109, a media accumulator-ejector 200 and a tamper 700.

Finisher 108 may include a stapler 112, a hole punch 113, one or more media sensors 114, various media reference and alignment surfaces and an output area 115 for holding finished media. Tamper 700 may also be located in finisher 108. While stapler 112 is shown in finisher 108 it may also be positioned adjacent to media accumulator-ejector 200 to staple media stacks formed therein.

Controller 103 includes a processor unit 110 and associated memory 111, and may be formed as one or more Application Specific Integrated Circuits (ASICs). Memory 111 may be any volatile or non-volatile memory or combination thereof such as, for example, random access memory (RAM), read only memory (ROM), flash memory and/or non-volatile RAM (NVRAM). Alternatively, memory 111 may be in the form of a separate electronic memory (e.g., RAM, ROM, and/or NVRAM), a hard drive, a CD or DVD drive, or any memory device convenient for use with controller 103. Provided in memory 111 is one or more look-up tables 111-1 and/or firmware modules 111-2 used for control of imaging device 102 and its attachments such as finisher 108 or media accumulator-ejector 200.

In FIG. 3, controller 103 is illustrated as being communicatively coupled with computer 150 via communication link 141, with user interface 107 via communication link 142, and with scanner system 160 via communication link 143. Controller 103 is illustrated as being communicatively coupled with print engine 104, finisher 108 and its internal components, media accumulator-ejector 200, components such as gate 134 and exit feed roll pair motor 136, and tamper 700 via communication link 144.

Computer 150 includes in its memory 151 a software program including program instructions that function as an imaging driver 152, e.g., printer/scanner driver software, for imaging device 102. Imaging driver 152 facilitates communication between imaging device 102 and computer 150. One aspect of imaging driver 152 may be, for example, to provide formatted print data to imaging device 102, and more particularly to print engine 104, to print an image. Another aspect of imaging driver 152 may be, for example, to facilitate collection of scanned data from scanner system 160. In some circumstances, it may be desirable to operate imaging device 102 in a standalone mode. In the standalone mode, imaging device 102 is capable of functioning without computer 150. Accordingly, all or a portion of imaging driver 152, or a similar driver, may be located in one or more firmware modules 111-2 within controller 103 of imaging device 102 so as to accommodate printing and/or scanning functionality when operating in the standalone mode.

Print engine 104, scanner system 160, user interface 107, finisher 108 and media accumulator-ejector 200 may be controlled by firmware modules, generally designated 111-2, maintained in memory 111 which may be performed by controller 103 or another processing element. Controller 103 may be, for example, a combined printer, scanner, media accumulator-ejector and finisher controller. Controller 103 serves to process print data and to operate print engine 104 and toner cartridge 191 during printing, to operate scanner system 160 and process data obtained via scanner system 160 for printing or transfer the data to computer 150, and to control operation of media accumulator-ejector 200 and finisher 108. Controller 103 may provide to computer 150 and/or to user interface 107 status indications and messages regarding the media, including scanned media and media to be printed, imaging device 102 itself or any of its subsystems, consumables status, etc. Computer 150 may provide operating commands to imaging device 102. Computer 150 may be located nearby imaging device 102 or be remotely connected to imaging device 102 via an internal or external computer network. Imaging device 102 may also be communicatively coupled to other imaging devices.

Scanner system 160 may employ scanning technology as is known in the art including for example, CCD scanners, optical reduction scanners or combinations of these and other scanner types. Scanner system 160 is illustrated as having an automatic document feeder (ADF) 161 having a media input tray 162 and a media output area 163. Two scan bars 166 may be provided—one in ADF 161 and the other in the base 165—to allow for scanning both surfaces of the media sheet as it is fed from input tray 162 along scan path SP to output area 163. Imaging device 102 may also be configured to be a printer without scanning Print engine 104 is illustrated as including a laser scan unit (LSU) 190, a toner cartridge 191, an imaging unit 192, and a fuser 193, all mounted within imaging device 102. Imaging unit 192 and toner cartridge 191 are supported in their operating positions so that toner cartridge 191 is operatively mated to imaging unit 192 while minimizing any unbalanced loading forces applied by the toner cartridge 191 on imaging unit 192. Imaging unit 192 is removably mounted within imaging device 102 and includes a developer unit 194 that houses a toner sump and a toner delivery system. The toner delivery system includes a toner adder roll that provides toner from the toner sump to a developer roll. A doctor blade provides a metered uniform layer of toner on the surface of the developer roll. Imaging unit 192 also includes a cleaner unit 195 that houses a photoconductive drum and a waste toner removal system. An exit port on toner cartridge 191 communicates with an entrance port on developer unit 194 allowing toner to be periodically transferred from toner cartridge 191 to resupply the toner sump in developer unit 194. Both imaging unit 192 and toner cartridge 191 may be replaceable items for imaging device 102. Imaging unit 192 and toner cartridge 191 may each have a memory device 196 mounted thereon for providing component authentication and information such as type of unit, capacity, toner type, toner loading, pages printed, etc. Memory device 196 is illustrated as being in operative communication with controller 103 via communication link 144. While print engine 104 is illustrated as being an electrophotographic printer, those skilled in the art will recognize that print engine 104 may be, for example, an ink jet printer and one or more ink cartridges or ink tanks or a thermal transfer printer; other printer mechanisms and associated image-forming material.

The electrophotographic imaging process is well known in the art and, therefore, will be only briefly described. During an imaging operation, laser scan unit 190 creates a latent image by discharging portions of the charged surface of photoconductive drum in cleaner unit 195. Toner is transferred from the toner sump in developer unit 194 to the latent image on the photoconductive drum by the developer roll to create a toned image. The toned image is then transferred either directly to a media sheet received in imaging unit 192 from one of media input trays 121 or to an intermediate transfer member and then to a media sheet. Next, the toned image is fused to the media sheet in fuser 193 and sent to an output location 133, finisher 108, a duplexer 130, or media accumulator-ejector 200. One or more gates 134, illustrated as being in operative communication with controller 103 via communication link 144, are used to direct the media sheet to output location 133, finisher 108, duplexer 130, or media accumulator-ejector 200. Toner remnants are removed from the photoconductive drum by the waste toner removal system housed within cleaner unit 195. As toner is depleted from developer unit 194, toner is transferred from toner cartridge 191 into developer unit 194. Controller 103 coordinates these activities including media movement occurring during the imaging process or during finishing.

Controller 103 also communicates with a controller 118 in option assembly 109, via communication link 144. A controller 118 is provided within each option assembly 109 that is attached to imaging device 102. Controller 118 operates various motors housed within option assembly 109 for feeding media from media path branches PB into media path P or media path extensions PX, as well as, feeding media along media path extensions PX. Controllers 103, 118 control the feeding of media along media path P and control the travel of media along media path P and media path extensions PX.

Imaging device 102 and option assembly 109 each also include a media feed system 120 having a removable media input tray 121 for holding media M to be printed or scanned, a pick mechanism 122, and a drive mechanism 123 positioned adjacent removable media input trays 121. Each media tray 121 also has a media dam assembly 124 and a feed roll assembly 125. In imaging device 102, pick mechanism 122 is mechanically coupled to drive mechanism 123 that is controlled by controller 103 via communication link 144. In option assembly 109, pick mechanism 122 is mechanically coupled to drive mechanism 123 that is controlled by controller 103 via controller 118 and communication link 144. In both imaging device 102 and option assembly 109, pick mechanisms 122 are illustrated in a position to drive a topmost media sheet from the media stack M into media dam assembly 124 which directs the picked sheet into media path P or extension PX. Bottom feed media trays may also be used. As is known, media dam assembly 124 may or may not contain one or more separator rolls and/or separator strips used to prevent shingled feeding of media from media stack M. Feed roll assemblies 125, comprised of two opposed rolls—a driven roll under control of controllers 103 and/or 118 and an idler roll, feed media from an inferior unit to a superior unit via a slot provided therein.

In imaging device 102, a media path P (shown in dashed line) is provided from removable media input tray 121 extending through print engine 104 to output area 133, or, when needed, to media accumulator-ejector 200 to finisher 108 or to duplexer 130. Media path P may also have extensions PX (shown in dashed line) and/or branches PB (shown in dotted line) from or to other removable media input trays as described herein such as those shown in option assembly 109. Media path P may include a multipurpose input tray 126 provided on the housing of imaging device 102 or may be incorporated into removable media tray 121 provided in imaging device 102 and a corresponding path branch PB that merges with the media path P within imaging device 102. Along media path P and its extensions PX are provided media position sensors 180-182 which are used to detect the position of the media, usually the leading and trailing edges of the media, as it moves along the media path P or path extension PX. Media position sensor 180 is located adjacent print engine 104, while media position sensors 181, 182 are positioned downstream from their respective media tray 121 along media path P or path extension PX. Media position sensor 180 also accommodates media fed along path branch PB from multipurpose media tray 126. Media position sensor 182 is illustrated at a position on path extension PX downstream of media tray 121 in option assembly 109. Additional media position sensors may be located throughout media path P and duplex path 131, when provided, and their positioning is a matter of design choice. Media position sensors 180-182 may be an optical interrupter or a limit switch or other type of edge detector as is known to a person of skill in the art and detect the leading and trailing edges of each sheet of media as it travels along the media path P, path branch PB, or path extension PX.

Media size sensors 183 are provided in image forming device 102 and each option assembly 109 to sense the size of media being fed from the removable media input trays 121. To determine media sizes such as Letter, A4, A6, Legal, etc., media size sensors 183 detect the location of adjustable trailing edge media supports and one or both adjustable media side edge media supports provided within removable media input trays 121 as is known in the art. Sensors 180-183 are in communication with controller 103 via communication link 145.

Figure 9:
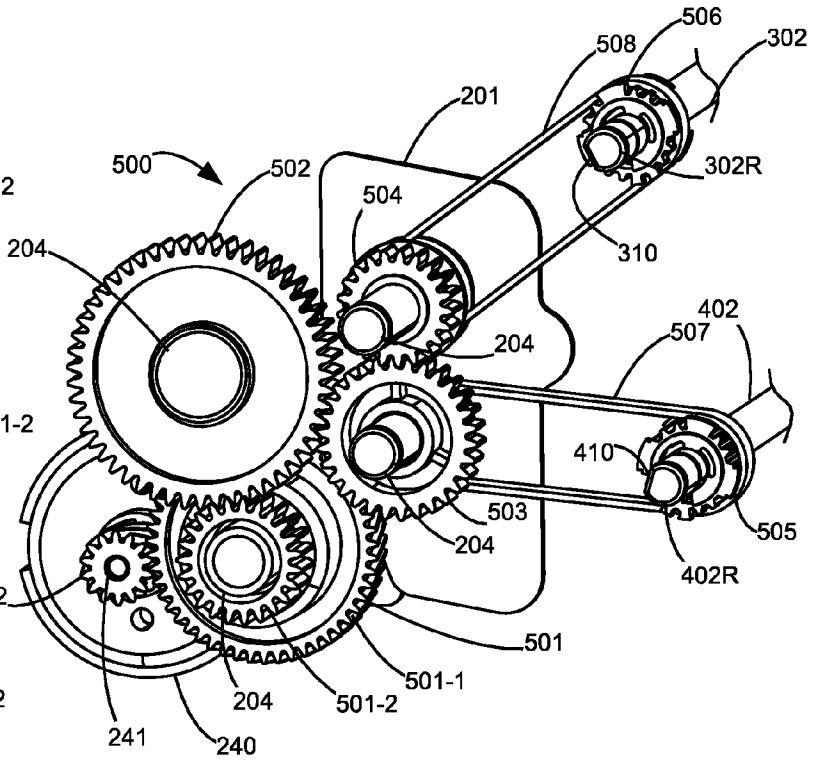
FIGS. 8-9 are perspective illustrations of an example drive mechanism of the example media accumulator-ejector of FIG. 4.
Figure 8:
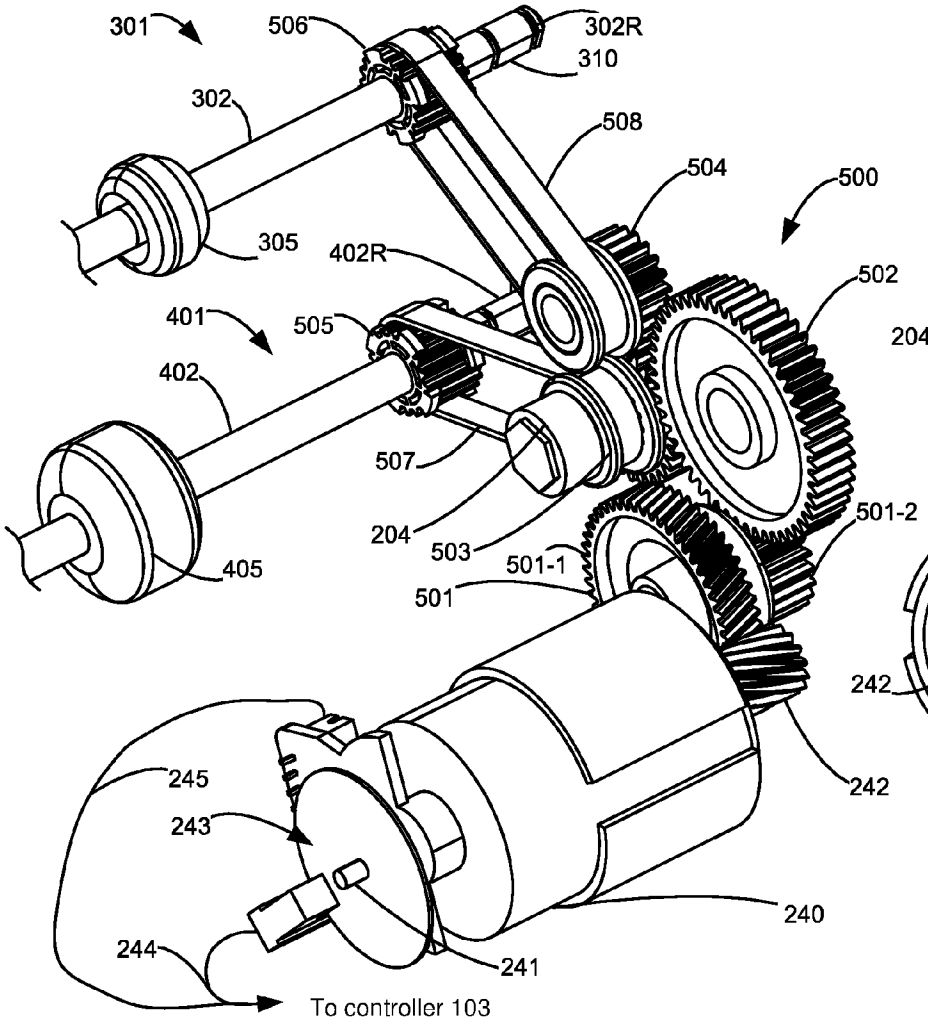
Figure 10:
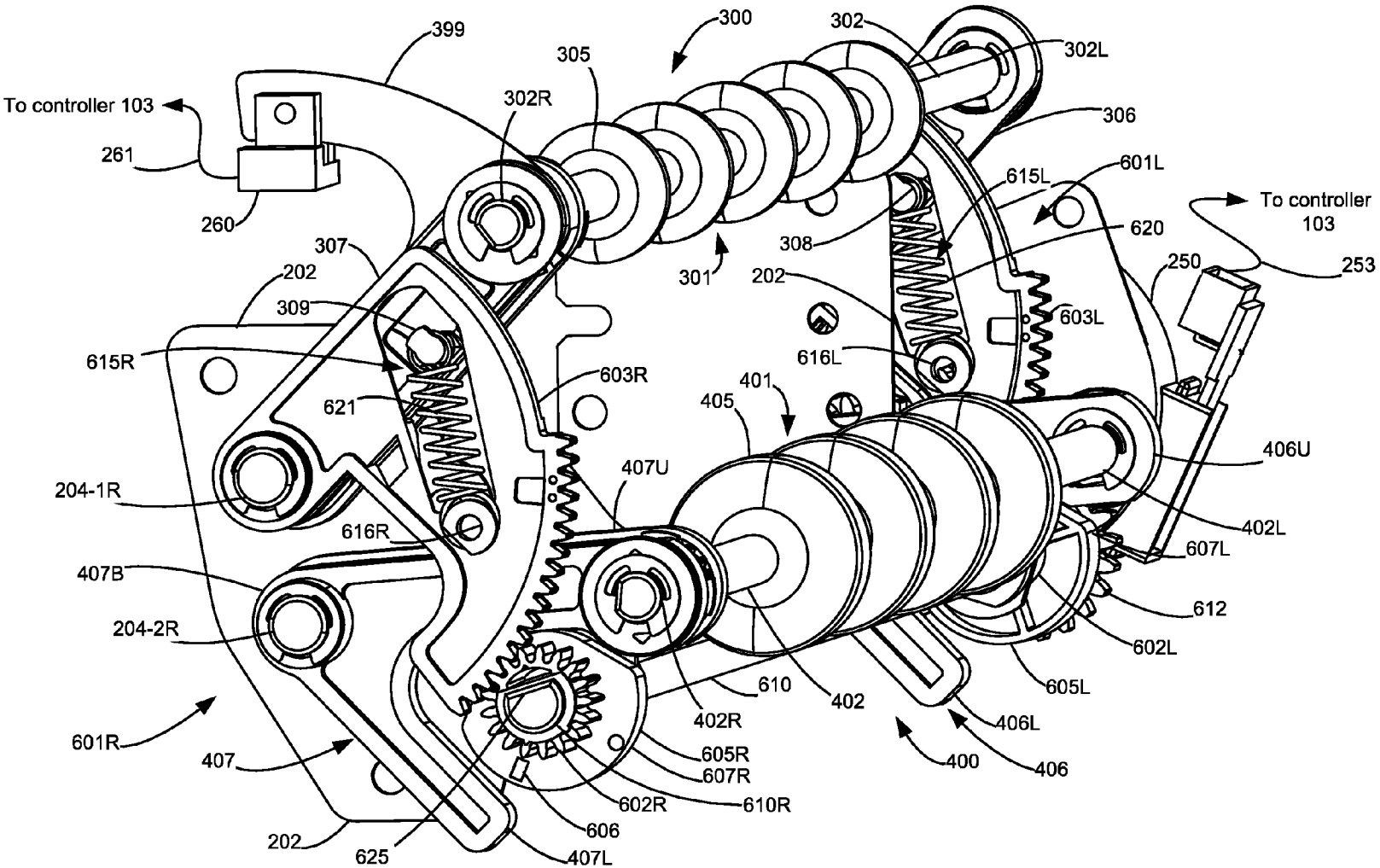
FIGS. 10-11 are perspective illustrations of the lift mechanism of the example media accumulator-ejector of FIG. 4.
Figure 11:
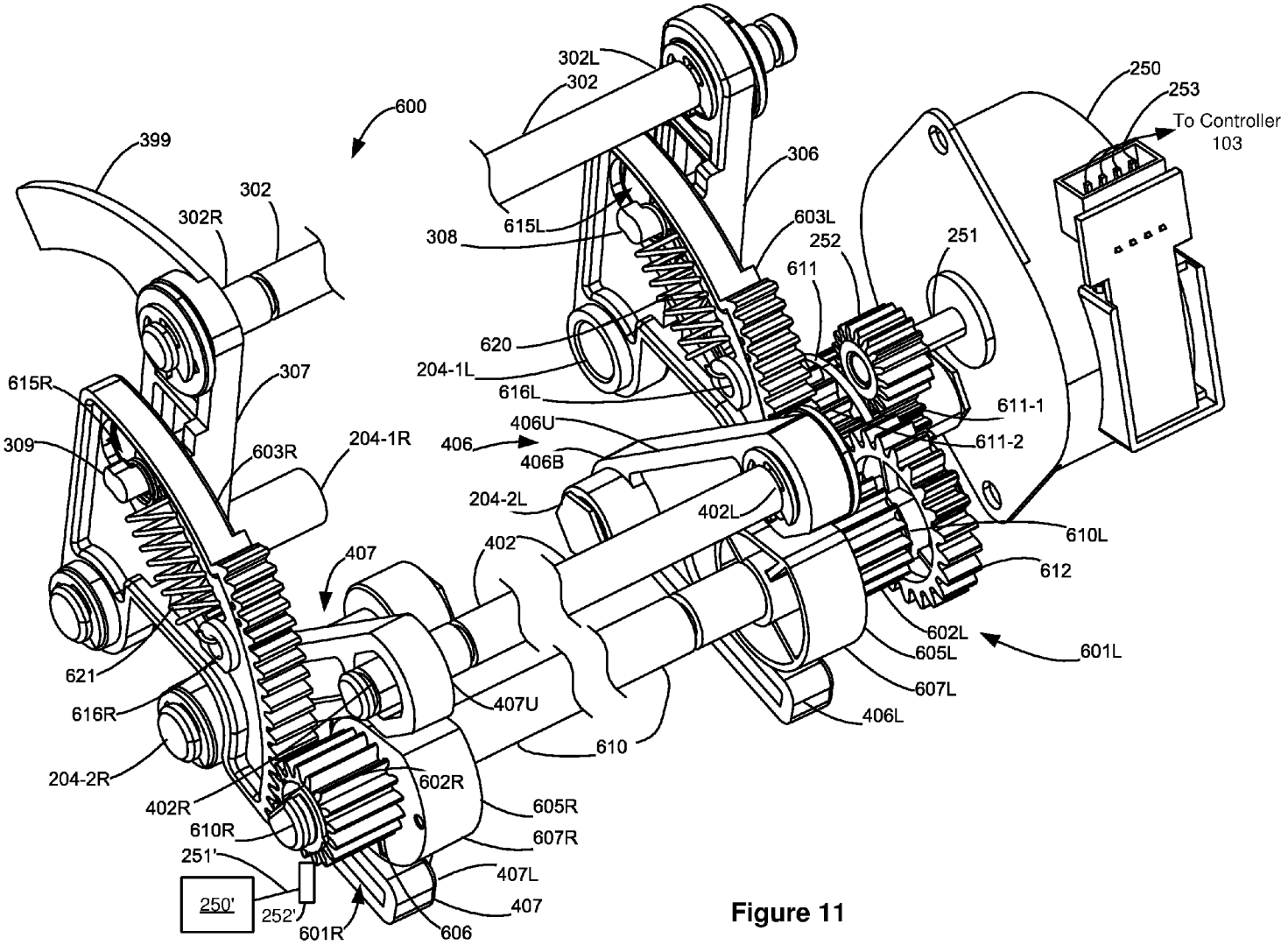

Media accumulator-ejector 200 is positioned on the media path P between the exit feed roll pair 135 and finisher 108. Exit feed roll pair 135 is driven by motor 136 that is in operative communication with controller 103 via communication link 144. Media accumulator-ejector 200 may be part of imaging device 102 or part of finisher 108 and is shown as a separate assembly for purposes of description. Media accumulator-ejector 200 includes a frame 202 having an accumulation zone 208 for collecting media. The accumulation zone 208 is formed in part by an accumulation plate 210 mounted on frame 202, an output bin 220, and a tamper 700. Tamper 700 includes motors 701, 702 that drive left and right tamping arms, respectively, used for aligning the side edges of a media stack that forms on accumulation plate 210. Mounted above and below a downstream end 212 of accumulation plate 210 are an upper roll assembly 300 and a lower roll assembly 400. Also found in frame 202 are a drive motor 240 and a lift motor 250, that are used respectively to rotate and to open and close the upper and lower roll assemblies 300, 400. A paddle motor 270, as described later, may also be provided. As shown in FIG. 9, an encoder 243 mounted on the shaft 241 of drive motor 240 provides a velocity signal to controller 103 for providing velocity control of upper and lower roll assemblies 300, 400 during media ejection. Also provided on frame 202 is a home position sensor 260. A flag 399 on upper roll assembly 300 actuates the home position sensor 260. A feed roll pair 235 may be provided downstream of accumulator-ejector 200 to continuously feed individual media sheets downstream for further processing such as hole-punching at hole punch 113. Details and operation of the media accumulator-ejector 200 will be further described with reference to FIGS. 4-15.

Figure 4:
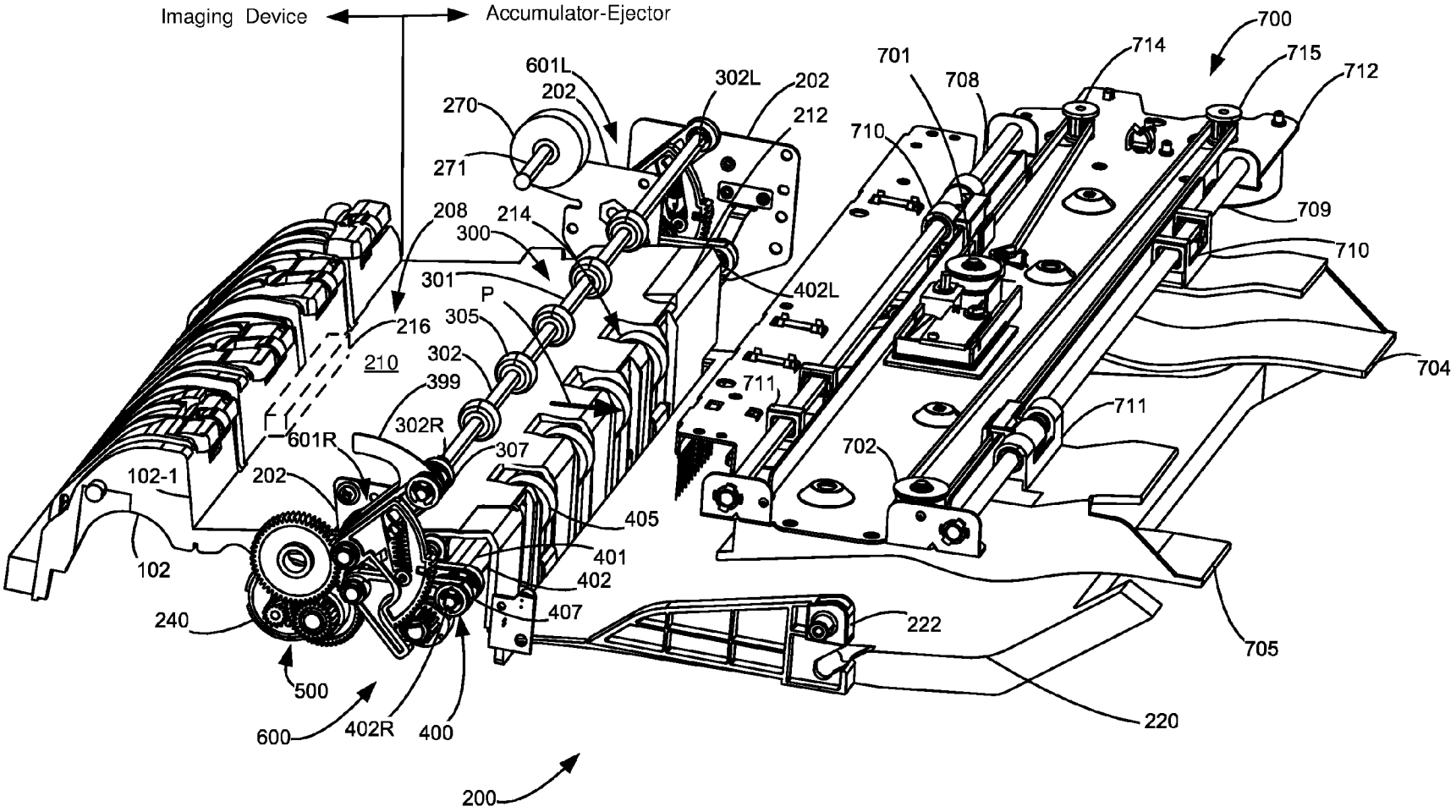
FIG. 4 is a perspective illustration of an example embodiment of a media accumulator-ejector of the present disclosure coupled with a media tamping system.

Referring to FIGS. 4-7B, an example media accumulator-ejector 200 is shown. In FIG. 4 the media feed direction through the accumulator-ejector 200 would be from left to right. A frame 202 includes an accumulation plate 210 that abuts a wall 102-1 of imaging device 102 adjacent to exit feed roll pair 135. Positioned at a downstream end 212 of accumulation plate 210 are an upper roll assembly 300, a lower roll assembly 400, a drive mechanism 500, and a lift mechanism 600. Drive mechanism 500 rotates upper and lower roll assemblies 300, 400 for ejecting accumulated media that is clamped between the two roll assemblies 300, 400 while lift mechanism 600, via two lift assemblies 601L, 601R, is used to move upper and lower roll assemblies 300, 400 between their respective home positions where they are positioned above and below the accumulation plate 210 to a position of engagement with the media on the accumulation plate 210. Adjacent to the downstream end 212 of accumulation plate 210 is an output bin 220 that is sized to receive the ejected media. Left and right wing walls 221, 222 may be provided on output bin 220. Positioned above output bin 220 is an optional tamper 700 that is illustrated as being aligned with the accumulation plate 210. Paddle motor 270 is shown mounted to frame 202 upstream of upper and lower roll assemblies 300, 400. Also shown in an alignment member 216 positioned transverse to accumulation plate 210 and transverse to wall 102-1 of imaging device 102 that may be used for aligning a trailing edge of a media sheet received on the accumulation plate 210.

Figure 5A:
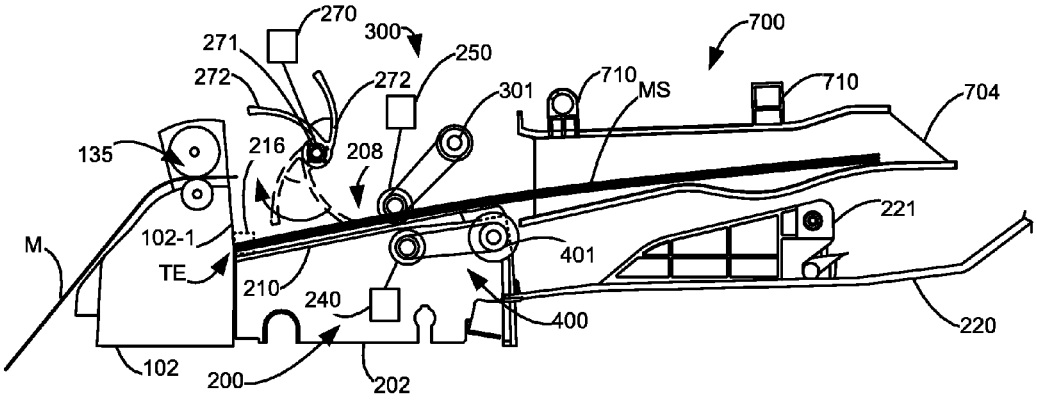
FIGS. 5A-5B are schematic illustrations of the operation of the example media accumulator-ejector of FIG. 4 during accumulation of media to create a media stack.
Figure 7A:
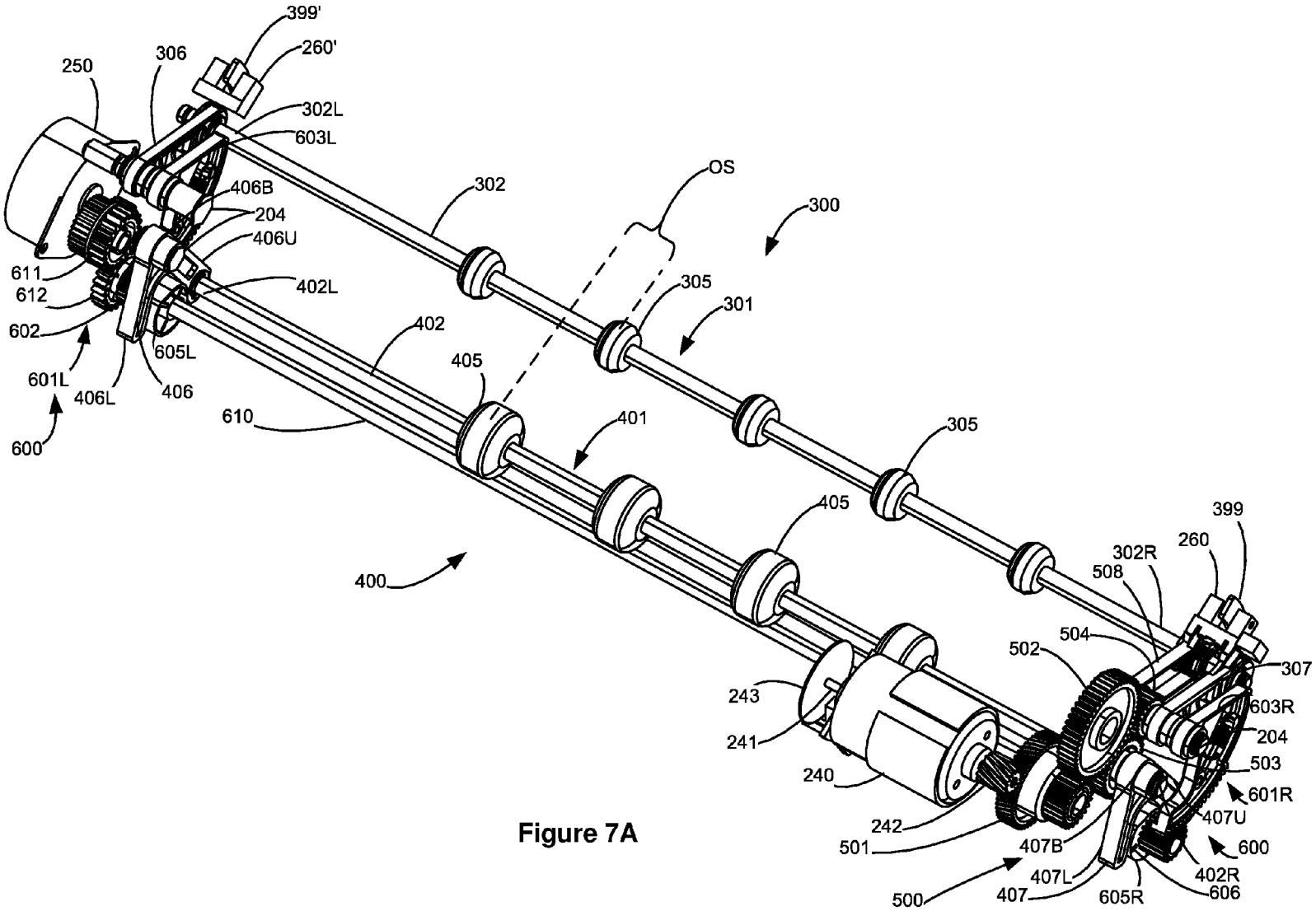
FIG. 7A is a perspective illustration of a corrugation roll assembly of the media accumulator-ejector of FIG. 4 shown coupled to the roll lift mechanism and the roll drive mechanism with the frame and accumulation plate removed.

Upper and lower roll assemblies 300, 400 are transverse to the media path P and are pivotally mounted to frame 202 to allow them to be rotated through an arc and engage with media that has accumulated on accumulation plate 210. As seen in FIG. 5A, upper roll assembly 300 includes an upper roll 301 mounted above accumulation plate 210 while lower roll assembly 400 includes a lower roll 401 mounted beneath accumulation plate 210. As seen in FIG. 7A, upper and lower rolls 301, 401 are illustrated as having a plurality of spaced apart wheels 305, 405 mounted on respective shafts 302, 402. The plurality of wheels 305 is axially offset from the plurality of wheels 405. Upper and lower rolls 301, 401 are also known as corrugation rolls, and, when these rolls engage with the media present in the accumulation zone 208, the media corrugates which stiffens the media in the drive direction. The downstream end 212 of accumulation plate 210 has a plurality of slots 214 aligned with the plurality of wheels 405 allowing wheels 405 to project above the surface of accumulation plate 210 when the lower roll 401 is raised. The left and right ends 302L, 302R of shaft 302 are rotatably coupled to one end of left and right upper linkages 306, 307, respectively, which in turn are rotatably coupled at their respective other ends to frame 202 via posts 204. Left and right lower linkages 406, 407 are similarly coupled at the left and right ends 402L, 402R of shaft 402 and frame 202 via posts 204.

Figure 7B:
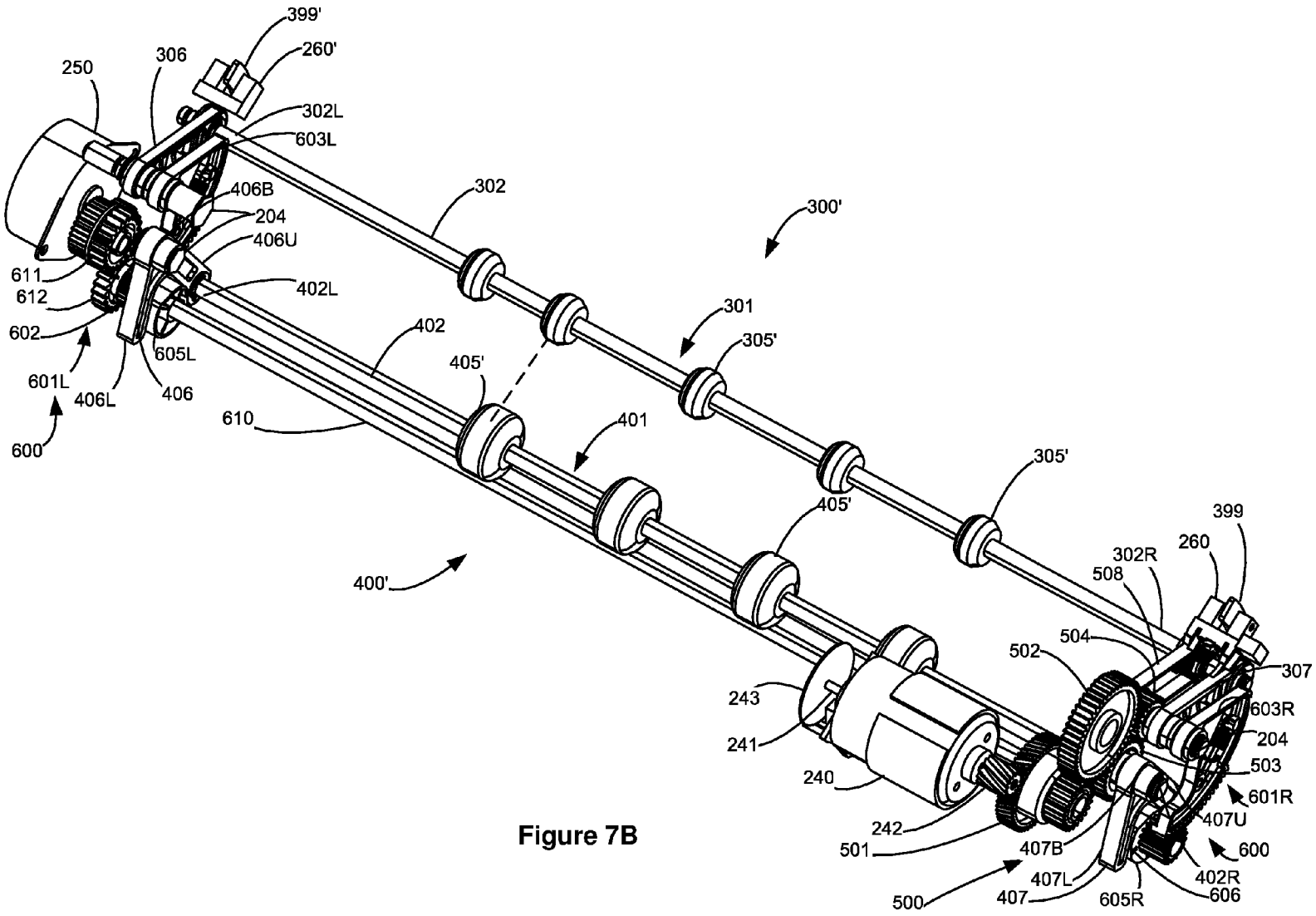
FIG. 7B is a perspective illustration of a pinch roll assembly useable in the media accumulator-ejector of FIG. 4 shown coupled to the roll lift mechanism and the roll drive mechanism with the frame and accumulation plate removed.

In FIG. 7B, upper and lower pinch roll assemblies 300', 400' are shown and are substantially the same as upper and lower corrugation roll assemblies 300, 400 and carry the same or similar reference numerals as those for upper and lower roll assemblies 300, 400. The plurality of wheels 305' of upper pinch roll assembly 300' are aligned with or oppose the plurality of wheels 405' of lower pinch roll assembly 400'. When upper and lower pinch roll assemblies 300', 400' are closed, the media stack is pinched between the respective pluralities of wheels 305', 405' and are used to provide a positive drive force on the top and bottom side of the media stack or a single media sheet when present.

Whether corrugation or pinch roll assemblies are employed, the media drive position for the upper and lower rolls 301, 401 is when the upper and lower roll assemblies 300, 400, or 300', 400' move to their respective closed positions. The lower roll assemblies 400, 400' move to a respective fixed upward position and the upper roll assemblies 300, 300' shaft move to a fixed downward position. The fixed positions of both assemblies are chosen to fully engage a single media sheet with a drive force. In the case of pinch rolls, the media sheet experiences opposing normal forces from each opposed wheel pair in contact with it. As the wheel pairs rotate, the sheet moves by means of the frictional force imparted to it by each wheel pair in direct contact with it. When the upper and lower roll assemblies 300, 400 are closed together, the corrugation wave generated in the media stack or media sheet by the staggered position of the plurality of wheels 305, 405 is counteracted by the beam strength within the media stack or media sheet which resists corrugation. The beam strength within the media stack or media sheet resists bending. The rounded profile of the plurality of wheels 305, 405 is chosen to obtain more contact between the media stack or media sheet with each wheel. Each media sheet corrugates in curved segments between the wheels that conform to the profile shape of the wheels. More contact by the media stack or each media sheet with each wheel ensures that the media stack or media sheet receives a high amount of friction from each wheel and counteracts any tendency for slippage. The net effect is the media stack itself or each media sheet applies a normal force against each wheel, and as the wheels rotate, the media stack or the media sheet is driven by means of the friction force imparted to it by each wheel that is in direct contact with it.

When in pass-through or continuous-feed mode, the upper and lower roll assemblies 300, 400, or 300', 400' are stationed in their respective closed positions and the top and bottom surfaces of each media sheet are in direct contact with the plurality of wheels 305, 405 or 305', 405' as the media sheet is driven through. When in accumulate mode to create a media stack, the upper and lower roll assemblies 300, 400, or 300', 400' are placed in their respective open positions and do not make contact with the media stack until all of the media sheets that comprise the job have been accumulated. After the last media sheet of an accumulated stack has arrived, the upper and lower roll assemblies 300, 400, or 300', 400' are rotated to their respective closed positions. Whether corrugation or pinch roll assemblies are employed, the spring-loaded shaft 302 (see FIG. 10) of the upper roll assembly 300, 300', accommodates to the media stack thickness, imparting a proportionally higher normal force to the thicker media stacks. With pinch roll assemblies 300', 400', a media stack is compressed to its solid thickness and the media stack experiences a pinch at each wheel pair. All the sheets interior to the media stack are coupled together by the normal force of the wheels to the stack, and the drive force of the wheels at the top and bottom sheets of the media stack transmits a frictional drive force to each interior media sheet by means of friction between each media sheet.

Figure 5B:
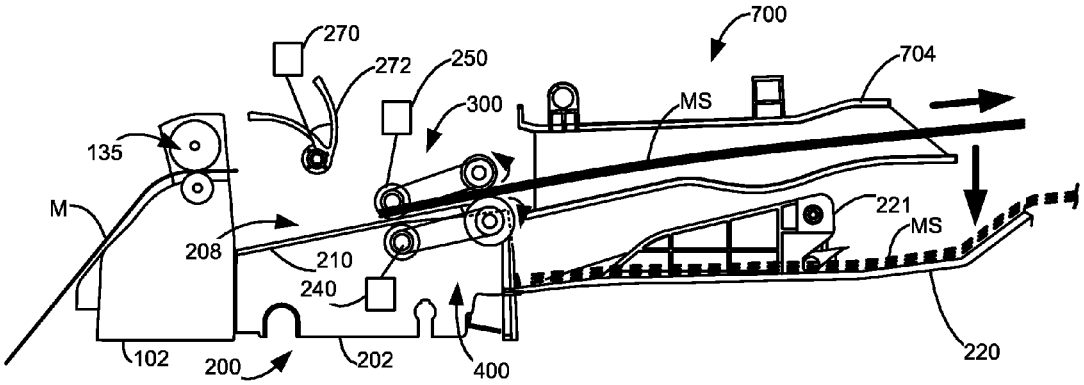

Tamper 700 aligns the accumulated media. As shown in FIG. 4, tamper 700 includes left and right arms 704, 705 that are attached to upstream and downstream rails 708, 709 via sleeves 710, 711, respectively. Upstream and downstream rails 708, 709 are mounted to a frame 712. Left arm 704 is coupled to motor 701 via a belt and pulley system 714 while right arm 705 is coupled to motor 702 via a second belt and pulley system 715. Tamper 700 may be used in conjunction with media accumulator-ejector 200 or media accumulator-ejector 200 may be used in a standalone manner FIGS. 5A-5B schematically illustrate the operation of media accumulator-ejector 200 with tamper 700. Initially, as illustrated in FIG. 5A, a media stack MS is accumulated on accumulation plate 210 as each media sheet M is fed from exit feed roll pair 135. After each media sheet M exits exit feed roll pair 135, paddle motor 270 rotates a plurality of flexible paddles 272, that may be mounted on its output shaft 271 or a separate shaft coupled to the output shaft 271 of paddle motor 270 that is also rotatably mounted to frame 202 transverse to the media feed direction. As indicated by the dashed lines, paddles 272 rotate in a direction opposite to the media feed direction and are in contact with the topmost media sheet M in the media stack MS. This paddle rotation moves each fed media sheet M so that the trailing edge TE abuts wall 102-1 of imaging device 102 or alignment member 216, if present, aligning the trailing edge TE of the media stack MS.

Figure 12:
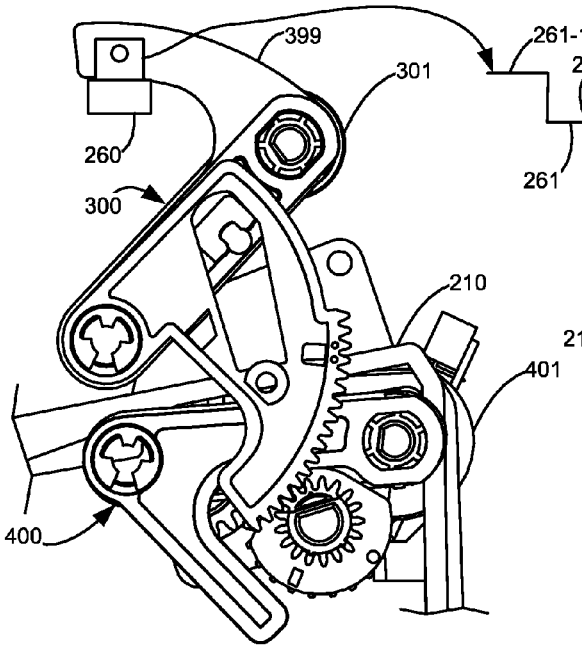
FIG. 12 illustrates the respective home positions of the upper and lower rolls of the example media accumulator-ejector of FIG. 4.
Figure 13:
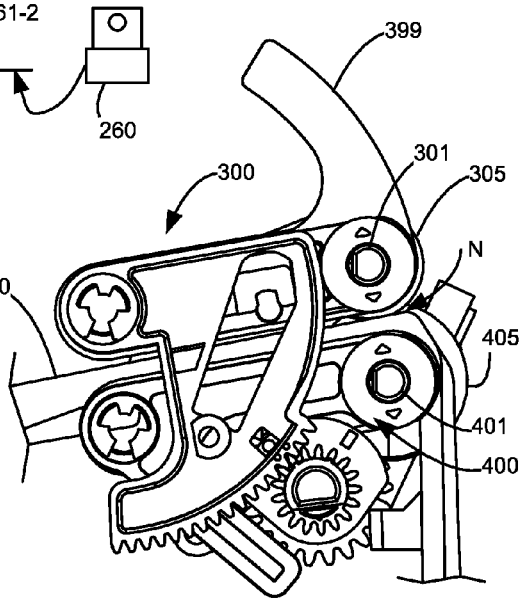
FIG. 13 illustrates an ejection position of the upper and lower rolls used for a continuous feeding of a plurality of individual media sheets.
Figure 14:
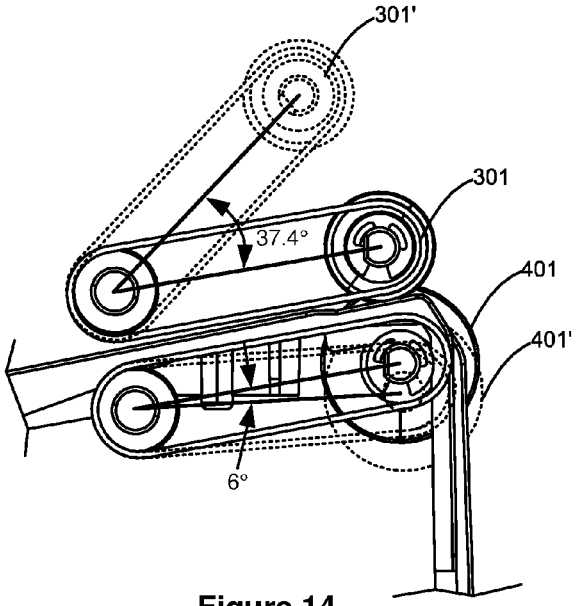
FIG. 14 illustrates the range of motion of the upper and lower rolls of the example media accumulator-ejector of FIG. 4.

When tamper 700 is provided, the media stack MS rests between the left and right arms 704, 705. Prior to being clamped by upper and lower rolls 301, 401, motors 701, 702 oscillate the left and right arms 704, 705 along upstream and downstream rails 708, 709 (see FIG. 4) to align the side edges of the media in the accumulated media stack MS. This may occur as each additional media sheet M is added to align the newly added media sheet to the media stack MS or after all the media sheets for media stack MS has been accumulated. During media accumulation, trailing edge alignment and side edge alignment, the upper and lower rolls 301, 401 are in their respective home positions where upper roll 301 is positioned above and away from accumulation plate 210 and lower roll 401 is beneath accumulation plate 210. This is done so the upper and lower rolls 301, 401 do not interfere with each media sheet as it is fed from imaging device 102. As shown in FIGS. 12-14, upper roll 301 moves through an arc of about 37.4 degrees while lower roll 401 will move through a corresponding arc of about 6 degrees. This range of motion allows the media accumulator-ejector 200 to handle continuous feeding of a plurality of individual media sheets as well as stacks of media containing up to about fifty media sheets.

When the media stack MS and side edge alignment is complete, stapling of media stack MS may occur. Thereafter, using lift motor 250, upper roll 301 is rotated downwardly to engage the top of the media stack MS while lower roll 401 is rotated upwardly with the plurality of wheels 405 raising through the plurality of slots 214 to engage with the bottom of the media stack MS, clamping the media stack MS between the two rolls.

The upper roll 301 may be spring-loaded, as later described, to accommodate different heights of media stacks and different types of media. Lift motor 250 may be used to control the amount of clamping force provided by the upper and lower rolls 301, 401 and applied to the media stack MS. The clamping force may be adjusted depending on the type and thickness of the media sheets contained in the media stack MS.

With the upper and lower rolls 301, 401 engaging the media stack MS, drive motor 240 is energized rotating the upper and lower rolls 301, 401 ejecting the media stack MS from accumulation plate 210, as a single unified body, as illustrated in FIG. 5B. Left and right arms 704, 705 of tamper 700 are moved apart allowing the media stack MS to fall into output bin 220. After the media stack MS has been ejected as a unified body from the accumulation plate 210, the upper and lower rolls 301, 401 return to their retracted or home position to await the next job.

When stapling is not used with media stack MS, the upper and lower rolls 301, 401 are driven at the same speed allowing the media sheets in media stack MS to remain together as a single unified body when being ejected. The driving force for ejecting the media stack may tends to separate the media stack MS when accelerating the stopped media stack MS to an ejection speed due to the contact of the upper and lower rolls 301, 401 with only the top and bottom media sheets in media stack MS. However, the corrugation forces provided by upper and lower corrugation rolls 301, 401 keep the media stack MS together and counter a driving force that is used to eject the media stack MS.

Figure 6:
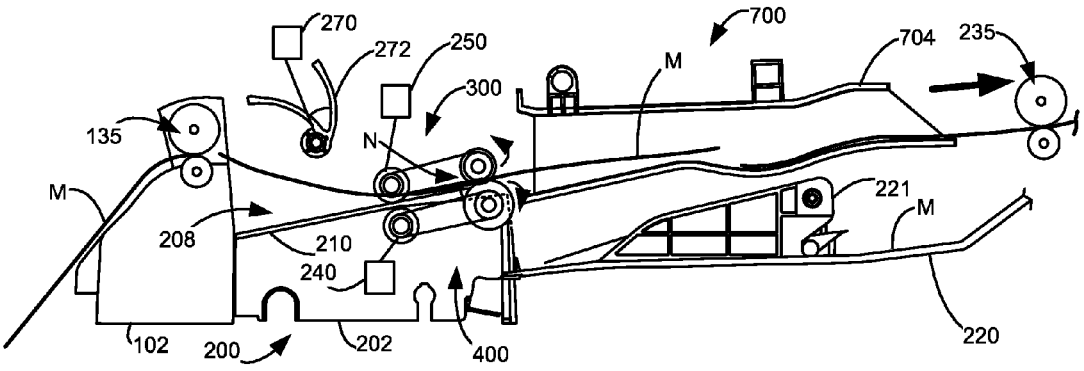
FIG. 6 is a schematic illustration of the operation of the example media accumulator-ejector of FIG. 4 during pass-through media feeding of individual media sheets.

During pass-through media feeding, the upper and lower rolls 301, 401 are driven by the lift motor 250 from their home positions to respective pass-through positions to receive and drive individual media sheets at process speed as shown in FIG. 6. Pass-through media handling can be the feeding of a single individual media sheet or the continuous feeding of a plurality of individual media sheets. Lower feed roll 401 is raised slightly such that the outer diameter of the plurality of wheels 405 is at or just slightly above the surface of accumulation plate 210 while upper feed roll 301 is lowered down so that the outer diameter of the plurality of wheels 305 is at or slightly below the outer diameter of the plurality of wheels 405 forming a corrugation feed nip N (see also FIG. 13). After each individual media sheet M is ejected from imaging device 102 and prior to being received on accumulation plate 210, the upper and lower rolls 301, 401 are accelerated by drive motor 240 to and maintained at a desired process speed, for example 70 pages per minute. The upper and lower rolls 301, 401 grasp the media sheet M in feed nip N, corrugating media sheet M, and feed the media sheet M downstream to feed roll pair 235 which in turn sends the media sheet M for further processing—such as for hole punching in finisher 108—or to an output bin such as output bin 115 or 133. The upper and lower rolls 301, 401 are typically closed by lift motor 250 to form feed nip N prior to the first media sheet of a continuous feed job reaching accumulator-ejector 200. For continuous feeding of a plurality of individual media sheets, the upper and lower rolls 301, 401 may remain in their pass-through positions during feeding of all the individual media sheets rather than opening and closing between each individual media sheet. The upper and lower rolls 301, 401 may also remain in their respective pass-through positions if a following job is on the way and is also a continuous feed job, or the upper and lower rolls 301, 401 may be retracted to their home positions if such a job is not being sent.

Referring now to FIG. 7A, the drive motor 240, the lift motor 250, the upper roll assembly 300, the lower roll assembly 400, the drive mechanism 500, and the lift mechanism 600 are shown with accumulation plate 210 and frame 202 removed for clarity. Home position sensor 260 is shown adjacent to the right end 302R of shaft 302 where flag 399 is mounted. Flag 399' and home position sensor 260' show an alternate mounting location at the left end 302L of shaft 302. Drive mechanism 500, drive motor 240 and encoder 243 are positioned adjacent to the right end 402R of shaft 402. Lift motor 250 is positioned adjacent to the left ends 302L, 402L of shaft 302, 402. Two lift mechanisms, generally indicated as right and left lift mechanisms 601R, 601L, are shown attached to the right ends 302R, 402R and left ends 302L, 402L of the upper and lower shafts 302, 402, respectively, of the upper and lower rolls 301, 401, respectively. As indicated by the parallel dashed lines, the offset OS between the plurality of wheels 305 on shaft 302 and the plurality of wheels 405 on shaft 402 can also be seen.

FIGS. 7A-9 illustrate drive mechanism 500 which may also be referred to as a gear train. Drive motor 240, which may be for example a DC servo motor 240, has output shaft 241 having an output gear 242, such as a pinion gear 242 on one end, and an encoder 243 mounted on the other. A motor signal 245, that is part of communication link 144, is provided to drive motor 240 by controller 103 while an encoder signal 244, also part of communication link 144, is provided to controller 103 and is used to provide speed control of drive motor 240 which in turn provides for a greater range of speeds available to feed or eject media. A compound gear 501 is coupled to output gear 242. Compound gear 501 has a first gear 501-1 coupled to output gear 242 and a second gear 501-2 coupled to an intermediate gear 502 which in turn is coupled to a lower pulley gear 503 that is coupled to an upper pulley gear 504 allowing lower and upper pulley gears 503, 504 to rotate in opposite directions when driven by intermediate gear 502. A pulley gear is the combination of a pulley and a gear. Lower pulley gear 503 is coupled to lower pulley 505 via lower belt 507. Lower pulley 505 is mounted adjacent to the right end 402R on shaft 402 of lower roll 401. Upper pulley gear 504 is coupled to upper pulley 506 via upper belt 508. Upper pulley 506 is mounted adjacent to the right end 302R on shaft 302 of upper roll 301. Shafts 302, 402 may be provided with flats 310, 410, respectively, for the mounting of upper and lower pulleys 506, 505. Pulley gears 503, 504 and pulleys 505, 506 as shown, as well as, belts 507, 508 may be provided with teeth or ribs as shown. When driven by drive motor 240, upper and lower rolls 301, 401 are rotated in opposite directions to eject media from accumulation plate 210. The gears 501-504 are rotatably mounted on posts 204 that are provided on frame 202. Some of the posts 204 on which various gears are mounted have been removed for purposes of clarity in the various figures.

FIGS. 7 and 10-15 illustrate lift mechanism 600 and its operation. Lift mechanism 600 includes two lift assemblies—left lift assembly 601L coupled to left linkages 306, 406 and right lift assembly 601R coupled to right linkages 307, 407 of the upper and lower roll assemblies 300, 400, respectively. Lift assemblies 601L, 601R may also be referred to as gear-linkage assemblies. Left and right linkages 306, 307 are illustrated as being straight bar links having one end rotatably connected to left and right ends 302L, 302R of shaft 302 and the other end to respective posts 204-1L, 204-1R. Left and right linkages 406, 407 are V-shaped linkages having a base 406B, 407B, an upper arm 406U, 407U, and a lower arm 406L, 407L, respectively. Bases 406B, 407B are rotatably coupled to posts 204-2L, 204-2R, respectively. Upper arms 406U, 407U are respectively coupled to left and right ends 402L, 402R of shaft 402. A lift shaft 610 interconnects the two lift assemblies 601L, 601R. Coupling gears 602L, 602R are mounted on lift shaft 610 at respective left and right ends, 610L, 610R. Mounted on lift shaft 610 inboard of coupling gears 602L, 602R are left and right camming wheels 605L, 605R. Left camming wheel 605L is positioned between the upper and lower arms 406U, 406L of left linkage 406 and right camming wheel 605R is positioned between the upper and lower arms 407U, 407L of right linkage 407. An alignment mark or timing mark 606 may be provided on each of left and right camming wheels 605L, 605R to ensure that the eccentric camming surfaces 607L, 607R on the outer circumference of camming wheels 605L, 605R on each are in the proper orientation with respect to sector gears 603L, 603R which in turn establishes the position of lower roll 401. As lift shaft 610 is rotated, camming surface 607L rotates and contacts one of upper and lower arms 406U, 406L of left linkage 406 and camming surface 607R rotates and contacts one of upper and lower arms 407U, 407L of right linkage 407 to raise and lower roll 401 while sector gears 603L, 603R are rotated to lower and raise upper roll 301. Lift assembly 601L, 601R and drive mechanism 500 allow the upper and lower rolls 301, 401 to move in synch but in opposite directions.

Each coupling gear 602L, 602R is coupled to a respective sector gear 603L, 603R that are each rotatably mounted to the posts 204-1L, 204-1R to which one end of the left and right linkages 306, 307 are also attached. This allows the sector gears 603L, 603R and their adjacent linkage to have the same axis of rotation about posts 204-1L, 204-1R. Hooks 308, 309 are provided on left and right linkages 306, 307. Slots 615L, 615R and holes 616L, 616R are provided adjacent to the bottom of slots 615L, 615R in left and right sector gears 603L, 603R. A biasing member 620, such as coil spring 620, is attached at one end to hook 308 and at the other end to hole 616L and is positioned in slot 615L. A second biasing member 621, such as coil spring 621, is attached at one end to hook 309 and at the other end to hole 616R and is positioned in slot 615R. Springs 620, 621 apply a biasing force to shaft 302 of upper roll 301 while allowing sector gears 603L, 603R to be flexibly coupled to respective left and right linkages 306, 307. Springs 620, 621 allow the upper roll 301 to adjust to the height of the media stack that is present on the accumulation plate 210 as the upper and lower rolls 301, 401 close together. The higher the media stack, the more the upper roll 301 can raise due to the action of springs 620, 621 even as lift motor 250 drives the upper and lower rolls 301, 401 together to corrugate the media stack.

Alternately sector gears 615L, 615R may also be connected directly to left and right ends 302L, 302R of shaft 302. A flat 625 (see FIG. 10) may be provided on each end of lift shaft 610 for the mounting of left and right coupling gears 602L, 602R and left and right camming wheels 605L, 605R. The linkage arrangement used to raise and lower upper roll 301 should not be considered as a limitation of the present design and other linkages may be used.

Lift motor 250 is shown positioned on frame 202 adjacent to the left ends 302L, 402L of shafts 302, 402. Lift motor 250 is communicatively coupled to controller 103 via motor signal line 253 that are part of communication link 144. Lift motor 250 may be a reversible stepper motor. As shown, lift motor 250 is coupled to lift shaft 610 via a series of gears. An output gear 252 is mounted on the output shaft 251 of lift motor 250 and is coupled to gear 611-1 of an intermediate compound gear 611. Gear 611-2 of compound gear 611 is coupled to intermediate gear 612 that is mounted on lift shaft 610. As shown, intermediate gear 612 is mounted on the left end 610L of lift shaft 610. As is known, controller 103 sends a pulsed drive signal via motor signal line 253 to stepper lift motor 250 to control its rotation which controls the positioning of upper and lower rolls 301, 401. Lift motor 250', output shaft 251' and output gear 252' (see FIG. 11) schematically show an alternate connection to right coupling gear 602R. The positioning and coupling of lift motor 250 to lift mechanism 600 is a matter of design choice and not one of limitation.

Operation of lift mechanism 600 is illustrated in FIGS. 12-14. In FIG. 12 upper roll assembly 300 and lower roll assembly 400 are shown in their respective home positions above and below accumulation plate 210. When upper roll assembly 300 is at its home position, flag 399 mounted on upper roll assembly 300 is positioned in home position sensor 260 at which point its output signal 261 is in a first state 261-1. In FIG. 13, upper and lower roll assemblies 300, 400 have moved away from their respective home positions. Upper roll assembly 300 has been rotated down while lower roll assembly 400 has been rotated up. The amount of rotation and clamping force is determined by controller 103 and based on the number of sheets and/or types of media sheets present on the accumulation plate 210 and is sufficient to ensure that the upper and lower roll assemblies 300, 400 will eject the media stack as a single unit. This information may be stored in one or more look-up tables 111-1. The positions shown for upper and lower roll assemblies 300, 400 in FIG. 13 may be the positions used for pass-through continuous media sheet feeding through the media accumulator-ejector 200. For single sheet feeding, the upper and lower roll assemblies 300, 400 are driven together to form a feed nip N, that is corrugated and into which the exiting individual media sheet is fed. Prior to arrival of the individual media sheet, drive motor 240 accelerates the upper and lower rolls 301, 401 so that the speed of the media sheet ejected from the upper and lower rolls 301, 401 substantially matches the process speed of the media sheet exiting imaging device 102. Thus, media accumulator-ejector 200 can readily handle and eject media stacks, and, when needed, can also feed a single media sheet or continuously feed a plurality of individual media sheets at process speed.

In FIG. 13, flag 399 has exited home position sensor 260 and its output signal 261 has transitioned to a second state 261-2. Home position sensor 260 is used to establish starting positions for the upper roll assembly 300 and lower roll assembly 400. By running lift motor 250 in a first direction until the output signal 261 of home position sensor 260 is in the first state, controller 103 can determine the home or initial positions of both the upper and lower roll assemblies 300, 400. FIG. 14 illustrates the range of motion of the upper and lower rolls 301, 401. Upper roll 301 moves between its home (highest) position indicated by the phantom line upper roll 301' to its closed (lowest) position indicated by the solid line upper roll 301. This is about 37.4 degrees of rotation for the example media accumulator-ejector 200. Lower roll 401 moves between its home (lowest) position indicated by the phantom line lower roll 401' to its closed (highest) position indicated by the solid line upper roll 401. This is about 6 degrees of rotation.

Figure 15:
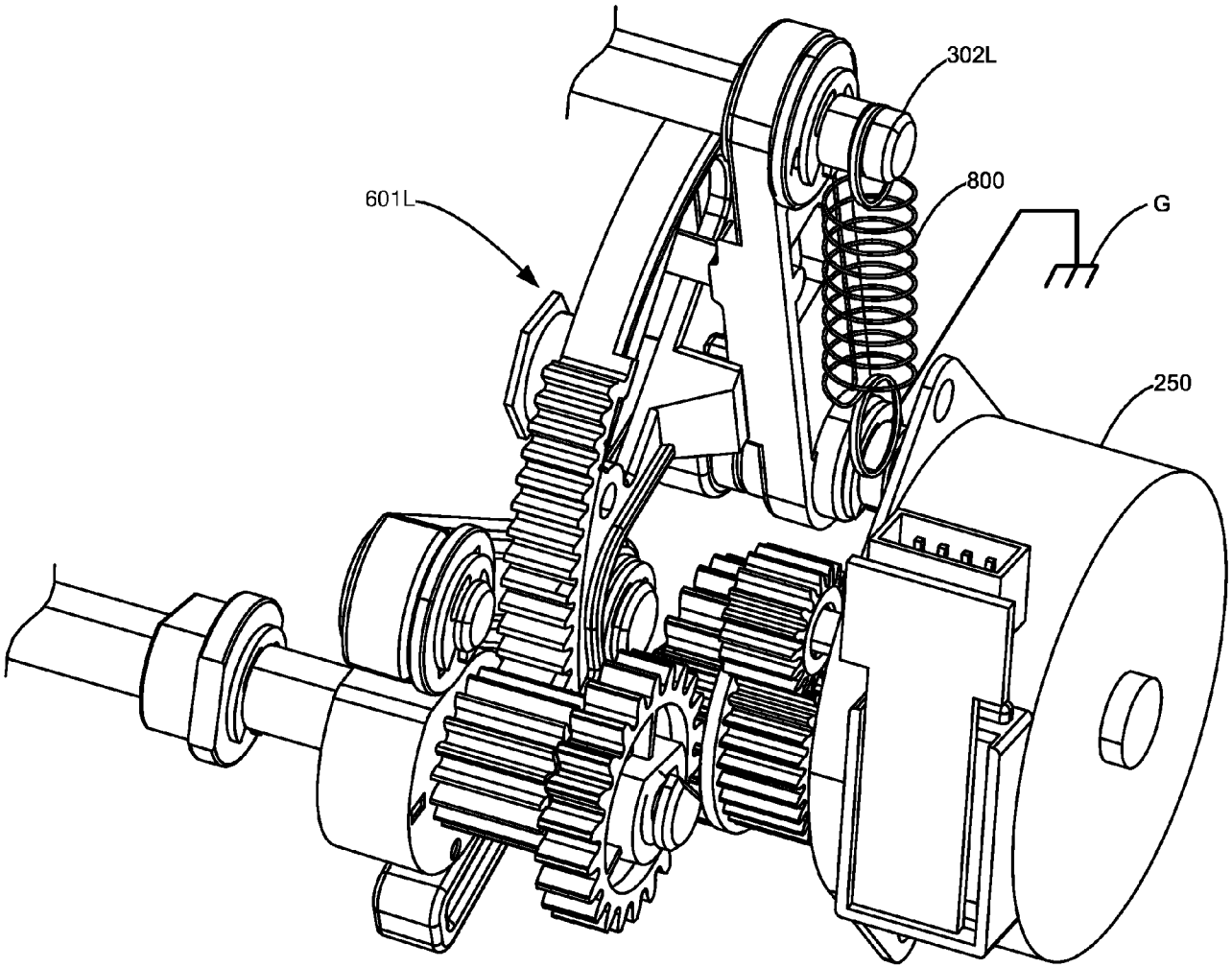
FIG. 15 illustrates an optional grounding spring coupled to the example media accumulator-ejector of FIG. 4.

FIG. 15 illustrates the use of a static discharge spring. Attached between upper shaft 302 of upper roll assembly 300 and ground G is a spring 800 that allows discharging of static electricity built up due to movement of media through media accumulator-ejector 200. Spring 800 is illustrated as being attached at left end 302L of shaft 302. The ground G may be frame 202.

Although compound gears and pulley gears have been shown, those of skill in the art understand that two individual gears may be substituted for the corresponding compound gear or that a gear and pulley may be substituted for the corresponding pulley gear. The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. A media accumulator-ejector for use with an imaging device, the media accumulator-ejector comprising:

a frame;

an accumulation zone formed on an accumulation plate mounted on the frame having an upstream end positioned adjacent a media output of the imaging device to receive media exiting the imaging device;

an upper roll and a lower roll with the upper roll having a first shaft having a left and a right end and the lower roll having a second shaft having a left and a right end, the upper and the lower rolls extending transversely across the accumulation plate adjacent to a downstream end of the accumulation plate, and, when in a respective home position, the upper roll is positioned above a surface of the accumulation plate and above a media path and the lower roll is positioned below the surface of the accumulation plate;

a drive mechanism mounted to the frame, the drive mechanism including a drive motor operatively coupled to the first and second shafts, the drive motor providing torque to rotate the lower and upper rolls in a direction to eject media from the accumulation zone;

a lift mechanism including a lift shaft operatively coupled to a left and a right gear-linkage assembly with the left and the right gear linkage assemblies rotatably coupled to the respective left and right ends of the first and the second shafts and to the frame, and a lift motor mounted to the frame and operatively coupled to the lift shaft wherein rotation of the lift motor in a first direction pivots the upper and the lower rolls apart and rotation in a second direction pivots the upper and the lower rolls toward each other;

a home position sensor positioned on the frame, the home position sensor having an output signal having a first state when the upper roll in at its home position and a second state when the upper roll is rotated toward the accumulation plate; and, a controller in operable communication with the lift motor, the drive motor and the home position sensor for controlling the operation thereof.

2. The media accumulator-ejector of claim 1, wherein the controller drives the lift motor to move the upper and the lower rolls in the first direction until the home position sensor output signal is in the first state, and, when a media stack has accumulated on the accumulation plate, the controller drives the lift motor in the second direction to move the upper and the lower rolls toward each other to grip the media stack and then drives the drive motor to rotate the upper and the lower rolls to eject the accumulated media stack as a unified stack from the accumulation plate.

3. The media accumulator-ejector of claim 2, further wherein, for a plurality of individual media sheets exiting from the imaging device and to be continuously fed from the accumulation plate without stacking, the controller drives the lift motor in the second direction to move the upper and the lower rolls to form a feed nip and, prior to a first media sheet of the plurality of individual media sheets arriving at the feed nip, drives the drive motor to rotate the upper and lower rolls to a speed matching a speed of the exiting plurality of individual media sheets.

4. The media accumulator-ejector of claim 1, wherein the upper roll rotates between its home position to a position adjacent the surface of the accumulation plate and the lower roll rotates between its home position below the surface of the accumulation plate to a position above and adjacent to the surface of the accumulation plate.

5. The media accumulator-ejector of claim 4, wherein the upper roll is rotatable through an arc of about 37 degrees and the lower roll is rotatable through an arc of about 6 degrees.

6. The media accumulator-ejector of claim 1, wherein a media bin is positioned adjacent to the downstream end of the accumulation plate.

7. The media accumulator-ejector of claim 1, wherein the drive motor is a DC servo motor having a velocity encoder mounted on the output shaft that is in operative communication with the controller.

8. The media accumulator-ejector of claim 1, wherein the lift motor is a reversible DC stepper motor.

9. The media accumulator-ejector of claim 1, further comprising:

a member transversely mounted in the accumulation zone;

a paddle motor mounted to the frame and in operative communication with the controller;

a plurality of flexible paddles operatively coupled to the paddle motor and rotatably mounted above the accumulation zone downstream of the member and upstream of the upper and lower rolls with the paddles and extending to the surface of the accumulation plate, wherein, after a media sheet to be stacked is received in the accumulation zone, the controller energizes the paddle motor to rotate the paddles to drive a trailing edge of the media sheet into the member to align the trailing edge of the media sheet.

10. The media accumulator-ejector of claim 9, wherein a tamper is mounted downstream of the upper and lower rolls, the tamper in operative communication with the controller wherein when actuated by the controller and with a media stack present in the accumulation zone, the tamper aligns a side edge of a newly received media sheet with a corresponding side edge of the media stack.

11. The media accumulator-ejector of claim 1, wherein the upper and lower rolls are corrugation rolls.

12. The media accumulator-ejector of claim 1, wherein the upper and lower rolls are pinch rolls.

13. The media accumulator-ejector of claim 1, further comprising:

the upper roll having a left and a right linkage having one end rotatably coupled to the left and the right ends of the first shaft, respectively, with the other end rotatably connected to the frame;

the lower roll having a left and a right V-linkage, each V-linkage rotatably coupled to the left and the right ends, respectively, of the second shaft and to the frame;

the drive mechanism having:

a DC drive motor mounted to the frame, the DC drive motor having an output shaft with a output gear operatively coupled to the first and second shafts;

a first and a second pulley gear operatively coupled to the output gear;

a first and a second pulley mounted on the first and second shafts, respectively;

a first and a second belt operatively coupled to the first and the second pulleys and to the first and the second pulley gears, respectively; and, the lift mechanism including:

the lift shaft having:

a left and a right coupling gear mounted on a respective left and a right end of the lift shaft; and, a left and a right camming wheel respectively positioned on the lift shaft adjacent to the left and the right coupling gears and between a lower and an upper arm of the left and right V-linkages, respectively;

a left and a right sector gear operably coupled to the respective left and right coupling gears and to the respective left and the right linkages of the upper roll wherein rotation of the left and right sector gears rotates the left and the right linkages of the upper roll;

the lift motor having an output shaft with an output gear operably coupled to one of the left and the right coupling gears where rotation of the lift motor in a first direction pivots the upper and the lower rolls apart and rotation in a second direction pivots the upper and the lower rolls toward each other;

a flag extending from one of the left and the right ends of the first shaft; and, the home position sensor positioned on the frame adjacent to the flag, the home position sensor having an output signal having the first state with the flag being present at the home position sensor when the upper roll and the lower rolls are at their respective home positions, and having the second state when the upper and lower rolls are pivoted away from their respective home positions;

wherein the controller drives the lift motor to move the upper and lower rolls in the first direction until the home position sensor output signal is in the first state, and, when a media stack has accumulated on the accumulation plate, the controller drives the lift motor in the second direction to move the upper and lower rolls to grip the accumulated media stack and then drives the drive motor to rotate the upper and lower rolls to eject the accumulated media stack as a unified body from the accumulation plate.

* * * * *